US005823692A

United States Patent [19]

Tolrud et al.

[11] Patent Number: 5,823,692

[45] Date of Patent: Oct. 20, 1998

[54] OPTICAL REGISTRATION SYSTEM FOR LABEL PRINTER CUTTER ATTACHMENT

[75] Inventors: Michael R. Tolrud, Chaska; Matthew K. Dunham, Eagan; Gary M. Klinefelter, Eden Prairie, all of Minn.

[73] Assignee: Fargo Electronics, Inc., Eden Prairie, Minn.

[21] Appl. No.: 847,712

[22] Filed: Apr. 28, 1997

Related U.S. Application Data

[63] Continuation-in-part of Ser. No. 709,689, Sep. 9, 1996.

[51] Int. Cl.[6] ..... B41J 11/44

[52] U.S. Cl. ..... 400/582; 400/711; 271/227; 226/27

[58] Field of Search ..... 400/582, 708, 400/711, 568, 709; 271/111, 226, 227; 347/104, 105; 226/27, 45

[56] References Cited

U.S. PATENT DOCUMENTS

| | | | |
|---|---|---|---|
| 2,111,619 | 3/1938 | Fleming | 197/130 |
| 2,181,992 | 12/1939 | Ghertman | 197/127 |
| 4,385,302 | 5/1983 | Moriguchi et al. | 346/76 |
| 4,531,851 | 7/1985 | Kondo et al. | 400/583.3 |
| 4,589,143 | 5/1986 | Baur et al. | 382/61 |
| 4,839,674 | 6/1989 | Hanagata et al. | 346/136 |
| 5,250,956 | 10/1993 | Haselby et al. | 346/1.1 |
| 5,266,967 | 11/1993 | Maslanka et al. | 400/711 |
| 5,289,208 | 2/1994 | Haselby | 346/140 |
| 5,297,017 | 3/1994 | Haselby et al. | 346/1.1 |
| 5,297,871 | 3/1994 | Fujioka | 400/568 |

OTHER PUBLICATIONS

Xerox Disclosure Journal, "Sensor Assemblies For Use In Feeding Clinched Computer Forms," vol. 17, No. 3, May/Jun. 1992.

*Primary Examiner*—Christopher A. Bennett
*Attorney, Agent, or Firm*—Westman, Champlin & Kelly, P.A.

[57] ABSTRACT

A detector assembly for detecting registration marks on a printed sheet when different color printing on different colored sheets is present has a pair of light sources and a light sensor. The light sources are of different colors selected to be complimentary such that one light source or the other will be capable of detecting a substantial range of contrasting registration marks placed on sheets that can be of various colors. Controls are used for selecting the light source that provides an output sensed by a light sensor when passing over the registration marks.

15 Claims, 6 Drawing Sheets

OPTICAL REGISTRATION SYSTEM FOR LABEL PRINTER CUTTER ATTACHMENT

CROSS REFERENCE TO RELATED APPLICATION

This is a continuation-in-part of co-pending application Ser. No. 08/709,689 filed Sep. 9, 1996 entitled LABEL PRINTER WITH CUTTER ATTACHMENT.

BACKGROUND OF THE INVENTION

The present invention relates to a cutter attachment for cutting labels produced by a label printer. More specifically, the present invention relates to an optical registration system for such a cutter attachment.

Digitally controlled cutters have been known in the prior art and used with various preprinted sheets of labels which are printed by a label printer. For example, the cutter can be aligned with the printed label and used to cut a contour around the label. In order for the cutter to accurately cut the desired path, the cutter must be accurately aligned or registered with printing on a sheet which carries the label. In the prior art, such alignment is typically through a visual inspection system in which the sheet which carries the label is aligned in a sheet feeder of the cutter. However, such an alignment system is slow and inaccurate and particularly unsuitable for a fully automated cutting system.

SUMMARY OF THE INVENTION

The present invention relates to an optical registration system capable of distinguishing marks of different colors on sheets that also may be colored. As disclosed an optical detector is operably coupled to the controls for a cutter member and provides a sensor output signal in response to detection of an optical registration symbol printed on the sheet. Control circuitry is coupled to control longitudinal movement of the paper and lateral positioning of the optical sensor. This provides x-y coordinates for location. After detecting the leading edge of the paper, the control circuitry provides signals to indicate the position of printed registration marks on the sheet. The detector has a sensor output that indicates detection of one segment of the optical registration mark. The control circuitry determines relative position of the cutter member and the printing on the sheet based upon the detection of the registration marks. The control circuitry provides signals to responsively cause the cutter member to cut the sheet along predetermined paths using the positioning signals for determining sheet position.

The optical registration marks on a sheet may be printed in a particular color, such as red, yellow or black on a white sheet or on a different color sheet. The optical detector has two different color light sources directed toward the sheet which have focal axes aimed at the same spot on the sheet. A broad band light detector or sensor is positioned on the detector to receive a narrow beam of reflected light. As the light source and sensor move as an assembly across a preprinted registration mark, the intensity of the reflected light rises and falls at the edges of the mark. When a selected threshold of light intensity is crossed, the light sensor provides a signal for each of the edges of the registration mark. The centerline of the mark is then calculated and precisely located. The registration mark used has a lateral line or bar component, that extends in direction of the width of the sheet adjacent one corner, and a longitudinal line or bar component that extends in direction of the longitudinal length of the sheet. Both of these lines are detected, to determine lateral (x axis) and longitudinal (y axis) positioning. The location of the printing on the sheet relative to a controlled cutter or tool is then calculated and any adjustments for lateral, longitudinal and angular (skew) position of the pattern to be cut or placed with a tool relative to the position of the sheet is provided to the cutter or tool control program.

The optical registration mark detector is used in connection with any type of a printer. The registration marks are printed at the same time that the labels are printed. Thus, the registration marks are precisely printed relative to the particular label (or other images) also printed on the sheet. Drive rollers drive the printed sheet longitudinally, past the optical detector and cutter member and the detector can be moved transversely, so that by proper control, the optical detector detects both the lateral component of the registration mark and the longitudinal component of the registration mark.

The invention relates to the utilization of different colored lights, or lights of different frequencies on a single mounting with a broad band light sensor to permit detection of different colored printing registration marks printed on various and different colored background paper.

The controls for the optical detector further include automatic light output level adjustment to insure reliable registration mark detection using various printing and sheet colors.

DETAILED DESCRIPTION OF THE PREFERRED EMBODIMENTS

Figure 1:
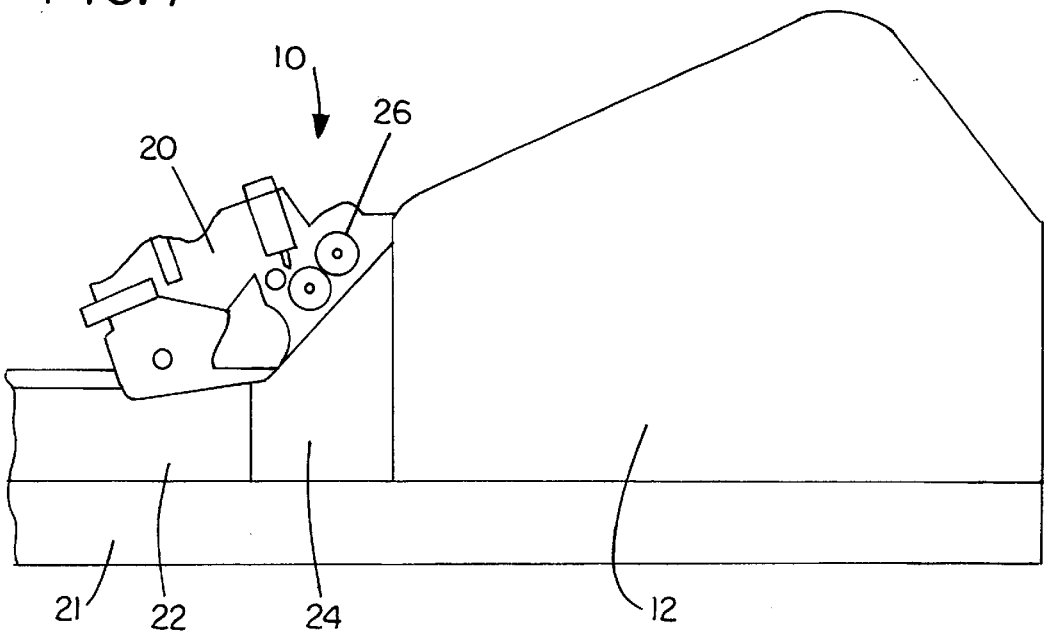
FIG. 1 is a schematic representation of a label printer and cutter assembly having an optical registration system made according to the present invention.

In one preferred embodiment, the present invention is for use with a combination label printer and cutter assembly such as is indicated generally at 10 in FIG. 1. The assembly 10 includes a label printer 12, which is digitally controlled to print a plurality of labels onto a sheet, so that there are a plurality of horizontal rows or "ranks" and vertical columns or files of labels. The labels can be oriented in any desired manner on the sheet, even randomly. A printed sheet 13 is shown schematically in FIG. 2 and while only four columns or files of labels are shown, along with three rows or ranks, it can be seen that individual labels indicated at 14 are separated by horizontal or lateral cut lines 16 and vertical or longitudinally extending cut lines 18. If the labels are oriented differently on the sheet or have an irregular shape, the cut lines may be programmed as desired, even independently of the printed shape.

At the same time as the labels 14 are printed one or more registration marks 19 are printed along one side of the printing. One mark 19 includes a laterally extending line or bar 19A and a longitudinally extending line or bar 19B, adjacent to a lateral and longitudinal edge of the sheet 13, respectively. A second registration mark 19 is printed spaced longitudinally from the first registration mark. The second registration mark has a laterally extending line or bar 19C and a vertically extending line or bar 19D.

The assembly 10 includes an optical detector and cutter assembly 20 that is mounted on the same or common frame 21 with the label printer 22 and a sheet supply tray 22. A detailed discussion of the printer and cutter assembly 10 is set forth in co-pending parent U.S. patent application Ser. No. 08/709,689, filed Sep. 9, 1996, entitled LABEL PRINTER WITH CUTTER ATTACHMENT, the disclosure of which that is not included is incorporated by reference.

Figure 3:
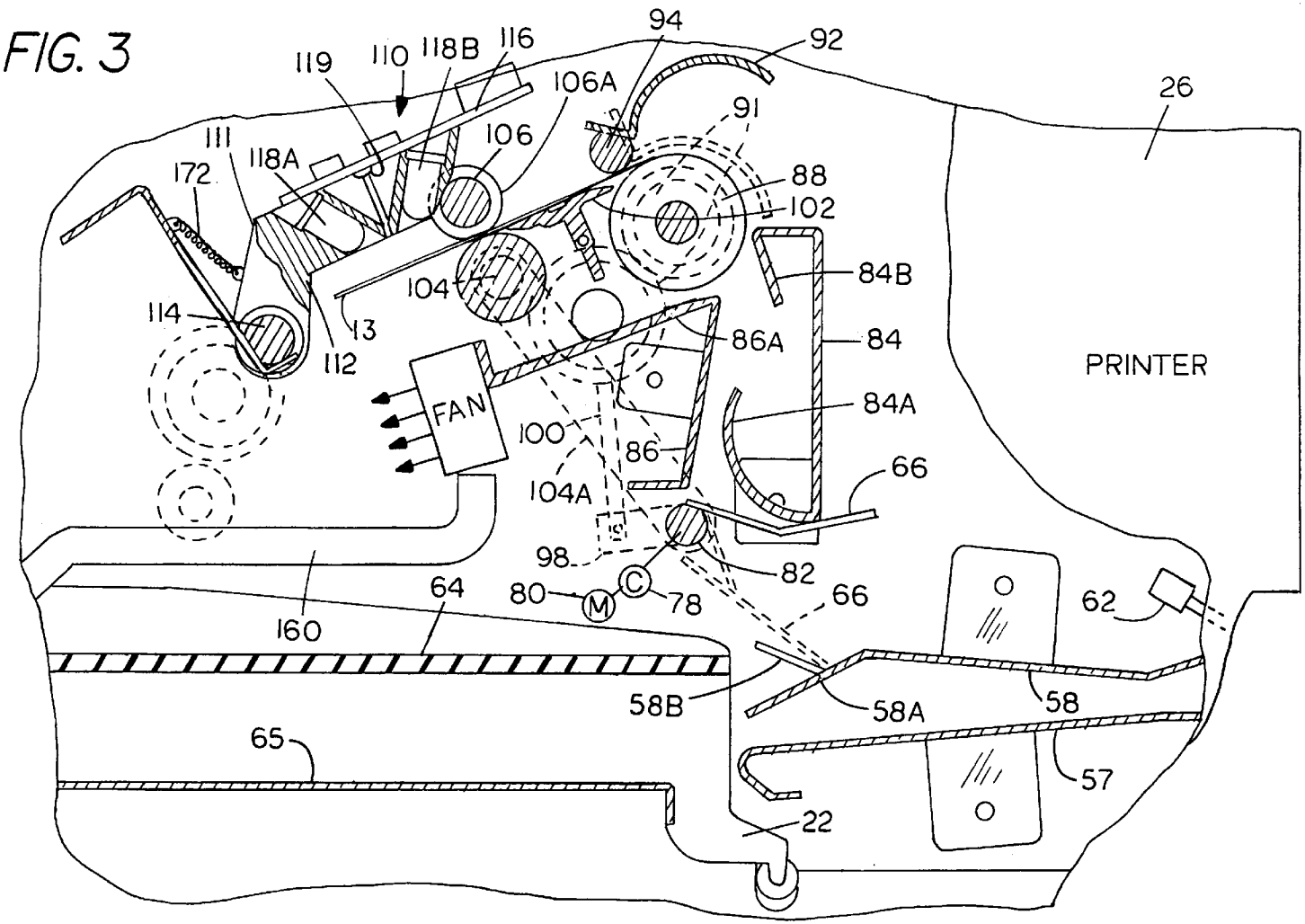
FIG. 3 is a fragmentary sectional view of a paper feed assembly feeding printed sheets into a cutter, with which an optical detector of the present invention is used.

A printer section indicated at 26 in FIG. 3 is shown only schematically and is used for printing a sheet 13 as disclosed in pending parent U.S. patent application Ser. No. 08/709, 689, filed Sep. 9, 1996.

The sheet 13 is fed through the printer 26 onto a guide plate 58 as it exits the feed and indexing rollers of the printer. The plate 58 is supported between the side plates 21A and 21B of the frame. A sensor schematically shown at 62 will sense the leading or front edge of the sheet 13 as it is being moved by indexing or feed rollers in the printer.

The sheet length is enough so that the feed rollers of the printer grip the sheet 13 to positively drive it on guide plate 58.

The guide plate 58 extends toward sheet tray 22 which has a support shelf 64. As shown in FIG. 3, a sheet scoop plate 66 is moved to position shown in solid lines so that the sheet 13 moves over a lip 58A, and onto the shelf 64.

Figure 2:
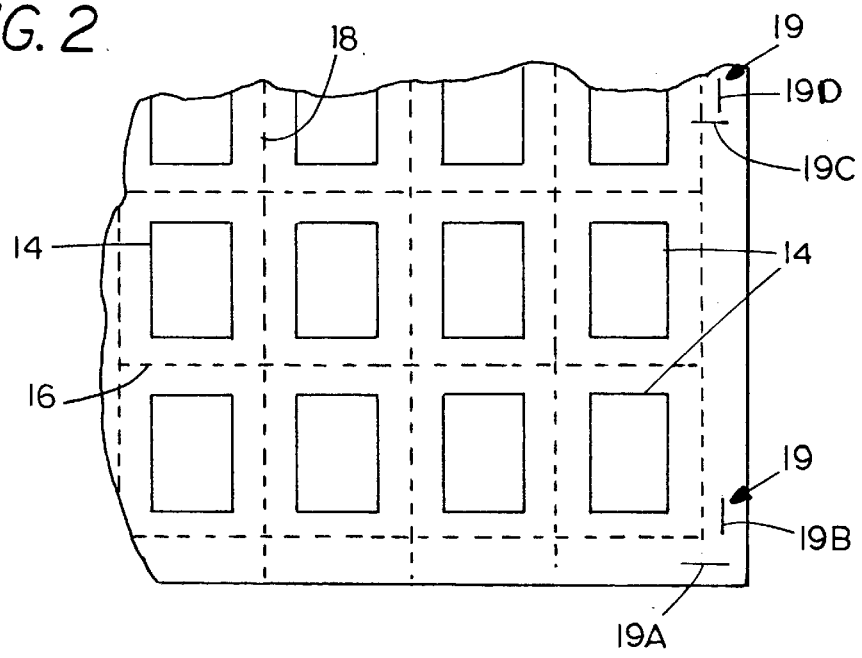
FIG. 2 is a partial schematic layout of a printer sheet having labels thereon showing typical print pattern registration marks.

The sheet leading edge sensor information from sensor 62 is provided back to the program control and stored until an end of paper sensor in the printer senses the trailing or rear end of the sheet 13 as it is fed through the printer on its initial pass. The length of the sheet 13 is measured by the top and end of paper sensors and the information is stored for use by the cutter control as well as for use in printing the labels. The sheet 13 is fed back into the printer and the printing is commenced. After positioning the sheet 13 for printing, at least one registration mark 19 is first printed onto the sheet as shown in FIG. 2. The registration mark 19 includes two orthogonal lines including the lateral or horizontal line 19A and the vertical or longitudinal line 19B. These are at right angles to each other, and will serve as a register of the printing of the individual labels 14 on the sheet and will be sensed by an optical detector of the present invention.

At an appropriate time, a drive motor 80, driving a shaft 82 through an electric clutch 78 will be operated in a direction to move the scoop plate 66 from its position shown in solid lines in FIG. 3 to the dotted line position, with the edge of the scoop plate stopped against a side lip 58B on the guide plate 58. The electric clutch 78 permits the scoop plate 66 to be stopped at its two positions against positive stops including the lip 58B and a lower end of a paper guide 84. The scoop plate 66 is held in the two positions with a spring load on the exterior of the frame.

The diverter position of scoop plate 66 shown in dotted lines in FIG. 3 is for a transfer of the printed sheet into the registration detector and cutter section 20. The printed sheet 13 is guided through a series of guides to the detector and cutter section. One such guide plate 84, that has a lower curved section 84A provides a space adjacent the scoop plate 66 for directing the printed sheet upwardly between the plate 84 and a guide plate 86.

FIG. 3 also illustrates a cutter feed roller 88 that has a shaft 90 driven by a gear set 91 from a shaft end of a cutter index roller 104. Gear set 91 is shown only in dotted lines (its on the outside of the frame plates). A cutter feed roller guide hood 92 is used adjacent the feed roller 88 for guiding the printed sheet into the detector and cutter section 20. It should be noted that the guide plate 84 lower section 84A serves to initially guide the printed sheet 13 relative to the plate 86. An upper section 84B of guide plate 84 guides the sheet 13 moving along the surface of the plate 86 toward the feed roller 88 to a position underneath the cutter feed roller guide hood 92 when the hood is in its dotted line position shown in FIG. 3. The scoop plate 66 is also shown also in dotted lines in the paper diverter position. The sheet guide plates are mounted to the frame side plates 21A and 21B, and extend between the side plates. Typical mounting tabs for the guide plates are shown schematically.

The guide hood 92 is mounted on a shaft 94 that is supported in suitable bearings on the frame side plates 21A and 21B. The scoop plate 66 has a lever 98 drivably connected thereto and shaft 94 also has a lever (not shown) on the same side of the frame as the lever 98. The shafts 82 and 94 are actuated simultaneously by levers on the shafts and a connector link 100 pivotally mounted to the levers, so that when the shaft 82 is driven by the motor 80 to move the scoop plate 66 between its position shown in FIG. 3 in solid lines and the position shown in dotted lines, the cutter feed roller guide hood 92 will also move between its solid line position and dotted line position. The guide hood 92 lifts up out of the way of the feed roller, and will clear a sheet that is reverse driven through the cutter index and feed rollers, as is needed for cutting labels.

A spring is connected to the lever 98 on shaft 82 to hold the scoop plate 66 and the guide hood 92 in the respective positions. The spring goes over center with respect to the axis of shaft 82 when the scoop plate 66 is shifted between its positions. This biases the scoop plate and guide hood to their positions and holds them positively in such position when the electric clutch 78 is released.

A printed sheet 13 moved by the rotating cutter feed roller 88, as guided by the guide hood 92, will pass over a cutting knife anvil 102 that is supported on the side frame plates 21A and 21B, and which will provide a support for the sheet in alignment with a cutter knife operated in accordance with the preprogrammed control for slitting the printed labels in an appropriate manner after the position of the sheet has been sensed. The sheet 13 engages and is driven by a cutter indexing roller 104 that has end sections that are knurled for driving the printed sheet in a positive, indexed manner for driving the sheet in two directions (forward and reverse). The paper feed roller 88 is a friction drive (urethane coated) roller driven by the gear set 91 from indexing roller 104 at a selected speed to insure that the paper does not bunch.

A pinch roller 106 runs on the top of the printed sheet 13, and provides pressure to cause the drive ends of the indexing roller 104 to engage the sheet positively. The pinch roller 106 is mounted on pivoting arms 108 (shown schematically in FIG. 4) and is spring loaded in a desired manner. The arms 108 are pivoted on shaft 94 outside the frame and extend toward the cutter end of the frame. The cutter indexing roller 104 is driven from a belt 104A shown in dotted lines in FIG. 3 from stepper motor 80 and controlled by the central controller according to a pre-program. The pinch roller 106 can be moved away from the indexing roller 104 to permit the sheet 13 to lay flat and straight before it is clamped on roller 104 by the pinch roller. The ends 108A of the arms 108 opposite the pivots on shaft 94 have laterally extending tabs 108B which are in registry with and may be engaged by actuator tabs 128A on a control plate 128, that is used to control one position of a working tool or cutter.

Figure 4:
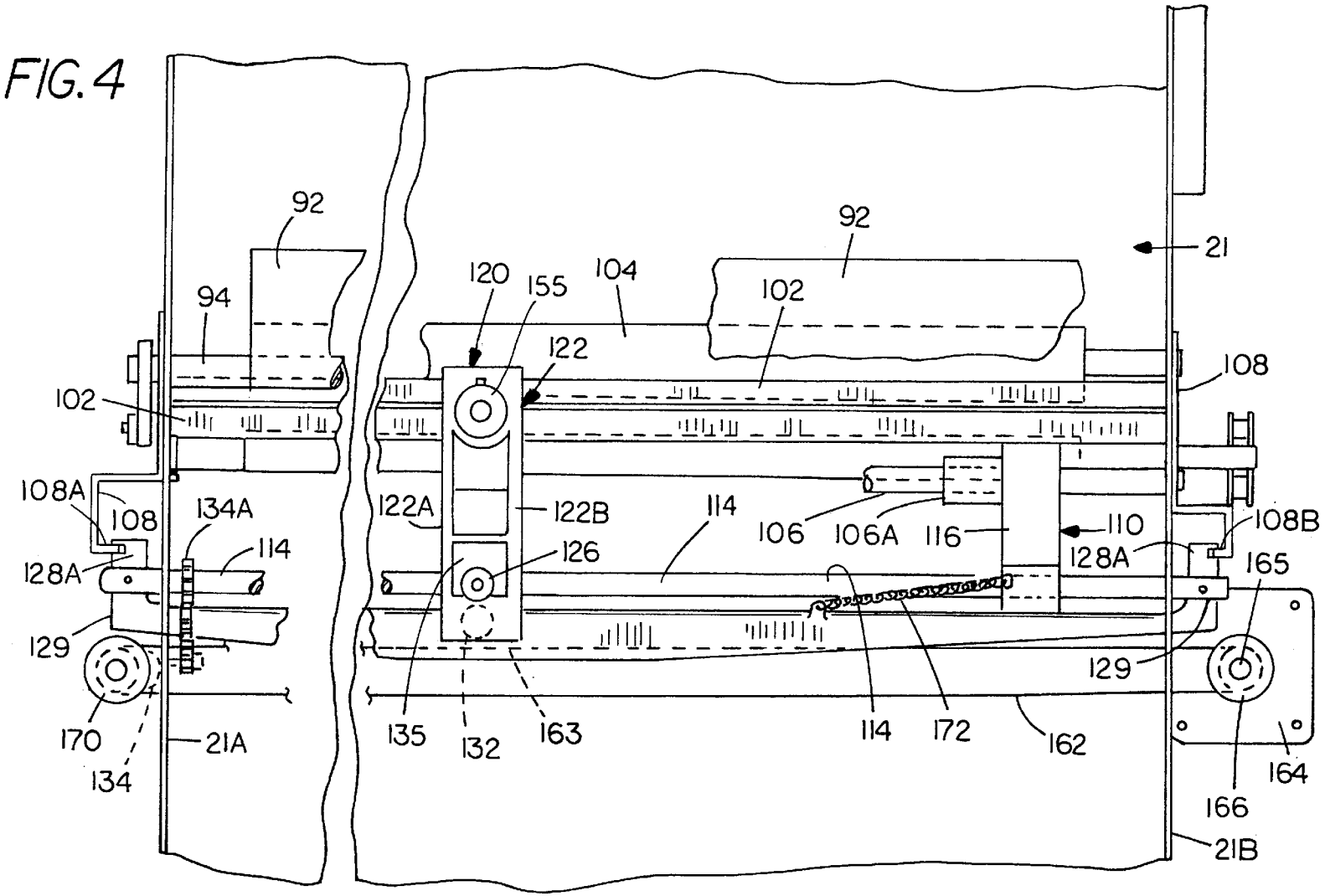
FIG. 4 is a fragmentary top plan view of the registration mark detector and cutter assembly showing portions of the picture frame.
Figure 5:
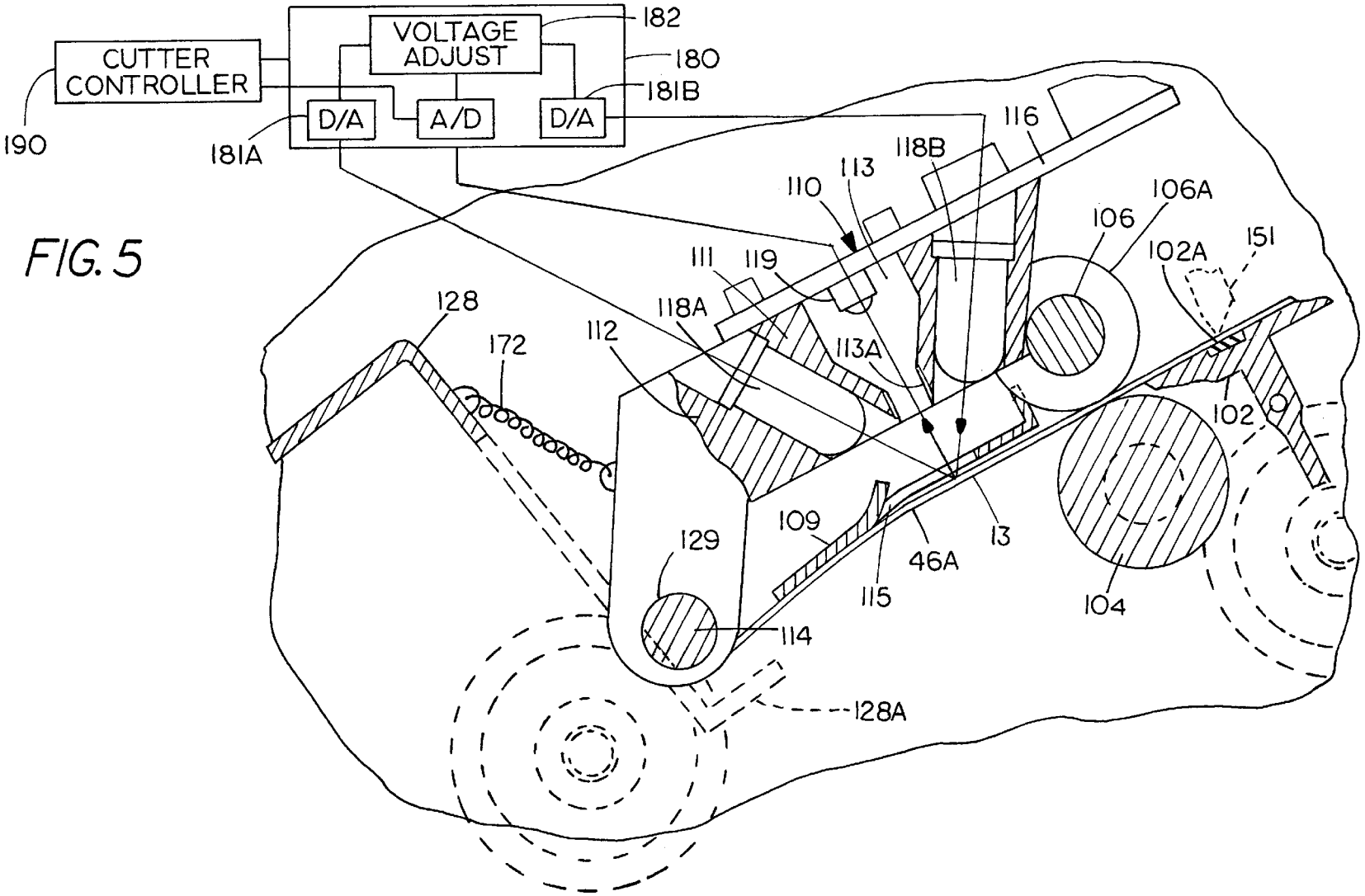
FIG. 5 is an enlarged side elevational view of the registration mark detector of the present invention.

As shown in FIGS. 3, 4 and 5, an optical registration mark detector assembly 110 is mounted on an arm 112 that in turn is rotatably mounted on a cross shaft 114. The cross shaft 114 is used for not only supporting the arm 112, which in turn supports the detector assembly 110, but also will support an arm carrying a tool, in this example a knife, that will slit the sheet 13 to form labels. The sheet 13 is usually two layers when labels are printed, an upper layer and a cover sheet, covering an adhesive on the upper level. The axis of shaft 114 lies along the plane tangent to cutter feed roller 88 and cutter indexing roller 104. This also is the plane of sheet 13 as it exits these rollers. A paper guide plate 109 is shown in FIG. 5 is mounted in position to deflect the paper and guide it below the detector assembly 110. The detector assembly 110 includes a circuit board 116 that is mounted on the arm 112. The arm 112 forms a housing 111. A pair of LED's or light sources 118A and 118B of different frequencies to permit detecting different colors are mounted in openings in housing 111, which are oriented so that the light sources have focus lines represented as the central axis lines of the lights, intercepting the upper surface of the paper sheet 13 as it is fed through the index roller 104 and the pinch roller 106. The light passes through and is reflected back through an opening 115 in guide plate 111.

An optical sensor 119, which senses a broad range of frequencies senses light intensity and is mounted on the circuit board 116 and fits into a chamber 113 in housing 111. Optical sensor 119 has a central axis that is centered in a controlled size aperture 113A and also coincides with the convergence point of the LED's 118A and 188B. When the end, called the front or leading end, of the printed sheet 13 passes under the center line of the optical sensor 119, the state of the sensed light changes because of the reflectivity of the sheet 13 and this will provide a signal indicating the front edge of the sheet 13 has reached a precise known position. This signal is used for reference in controlling the optical detector and cutter assembly, and is initially used to indicate that the sheet 13 is entering the cutter or that the sheet is exiting the cutter in reverse direction. The length of the sheet 13 has been determined in the printer, so the amount of sheet fed to clear roller 88 is known. The guide hood 92 then can move to its solid line position to permit sheet 13 to be moved by rollers 104 (and 106) back and forth for optical detector registration and cutting operations. Signals from the sensor 119 of detector assembly 110 are sent to the control circuitry for controlling the cutter, and for controlling the cutter feed rollers, as well as for controlling the printer, so that it is known that the printed sheet 13 is aligned with the optical detector and cutter assembly 20.

The cutter can be any desired cutter. The cutter is driven transversely to slide along shaft 114, and when adjacent the right side of the printer by side plate 21B, it will cause movement of the detector assembly 110 transversely for sensing the right longitudinal edge of the sheet and the longitudinally extending registration mark.

A cutter assembly 120 includes a mounting arm 122 which is rotatably mounted on the shaft 114. The arm 122 is formed to have two spaced walls 122A and 122B.

Figure 6:
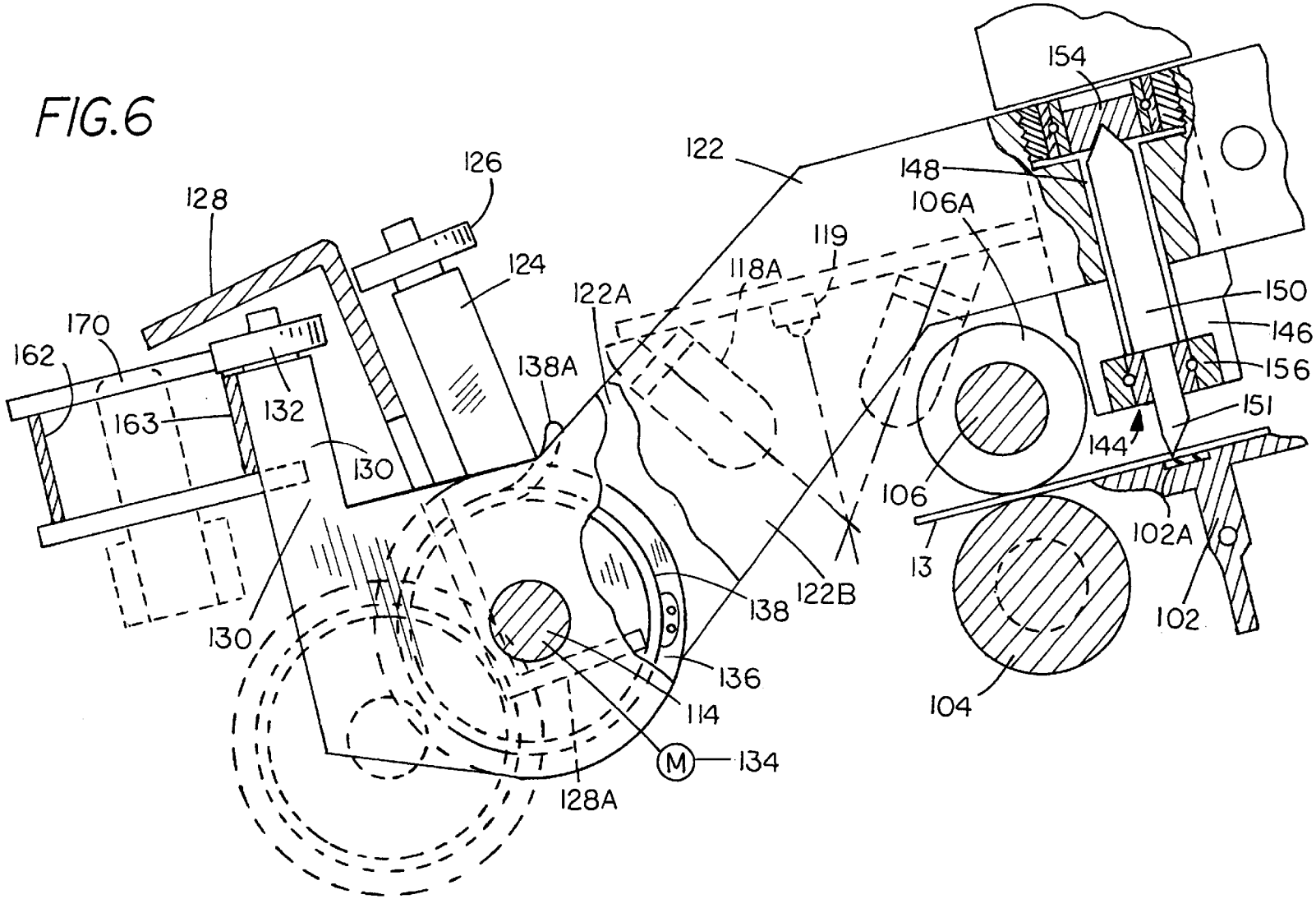
FIG. 6 is an elongated side view of a cutter assembly with parts in section and parts broken away.

The cutter arm 122 has an integral, upwardly extending column 130 (see FIG. 6) that has a wheel 132 rotatably mounted thereon about a generally upright axis on a side of shaft 114 opposite the direction of extension of arm 122. The wheel 132 will engage a back surface of control plate or flange 128, which in turn has depending end leg section 129 (FIG. 4) drivably mounted to the ends of shaft 114 on the outside of the frame side plates 21A and 21B. The column 130 forms a cutter arm lifter when the control plate 128 is moved in counter clockwise direction as shown in FIG. 6. The arm 122 is rotatably mounted as well as axially slidable on the shaft 114.

A cutter loading arm 124 is fixed to a hub 136 that is positioned between the two spaced apart side plates 122A and 122B of the arm assembly 122. Hub 136 carries torsion springs 138 that exert a bias force on the arm 122, so that when the control plate 128 is moved by driving the shaft 114 through a connected stepper motor 134 in clockwise direction, the arm 124 will pivot hub 136 about the shaft 114. A separate torsion spring 138 is wrapped around each of the side portions of the hub as shown in FIG. 4. Inturned first ends of the torsion spring are inserted in small bores so they are fixed to the hub 136 and opposite ends 138A of the torsion springs on each side of the hub 136, are looped over an edge of the adjacent side plates 122A and 122B of the arm 122 so that they exert a resilient force tending to rotate the arm 122 in a clockwise direction in FIG. 6. The only loading of the cutter arm 122 in clockwise direction is through the torsion springs 138 as driven by arm 124 and hub 136.

When the arm 122 is to be raised, the control plate 128 will be moved by driving shaft 114 with a stepper motor 134 (through a gear set 134A, shown in FIG. 4) in counter clockwise direction to engage the wheel 132 to move the column 130 and lift the outer end of arm 122. The outer end of the arm 122 carries a knife assembly indicated at 144, with a rotatable knife shaft 150 that extends through a bore 148 and which is mounted in bearings 154 and 156. The knife has a sharpened edge 151, in order to provide a lead in for cutting or slitting the sheet around the labels. The cutter knife end 151 is aligned with the anvil member 102. The cutter arm can be actuated to position the knife for engaging the sheet and making a slit that is of a substantially controlled depth (to cut the label without cutting through the backing sheet).

The control plate 128 also serves as the actuator for lifting the cutter pinch roller 106. The control plate has the tabs 128A on the outer sides of each of the side plates 21A and 21B that project toward the cutter pinch roller 106 and align with, but are spaced from the tabs 108B on arms 108 in normal use. The control plate 128 is actuable in counter clockwise direction, and can be rotated by stepper motor 134 sufficiently so tabs 128A engage tabs 108B to lift the free ends 108A of arms 108 to space the pinch roller 106 slightly from the index roller 104 when desired for permitting the sheet 13 to seek its own orientation.

The cutter knife edge 151 can be lifted off the sheet being cut by the cutter assembly without lifting the pinch roller 106 since the actuator tabs 128A do not engage the tabs 108B until the control plate 128 has rotated a selected amount. The "lost motion" between the tabs 108B and 128A permits lifting the cutter knife or other implement without releasing the pinch roller.

The cutter assembly can be moved axially along the shaft 114, which is in the lateral direction of the sheet as shown in FIG. 4. An endless belt 162, which can be a positive drive belt such as a cog belt, is drivably connected at 163 to the column 130 as shown schematically in FIG. 6. A stepper motor 164 having a substantially vertical shaft 165 is mounted on side plate 21B of the frame. The motor shaft 165 drives a pulley 166. The belt 162 is mounted around the pulley 166, and extends laterally across the frame 21 as shown in FIG. 3, and is mounted over an idler pulley 170 rotatably mounted on the opposite side of the frame 21. Whenever the stepper motor 164 is driven, the belt 162 will move and will move the cutter assembly 120 laterally relative to the sheet along the shaft 114. This gives the "X" coordinate for the cuts to be made and also for positioning the detector assembly 110.

The detector mounting arm 112 is urged laterally toward the cutter arm 122 by use of a tension spring 172, which hooks onto the arm 112 in a suitable manner, and also onto the control plate 128. The outer end of sensor arm 112, as shown rides on the metal shaft of the pinch roller 106, and it will be stopped from lateral movement toward cutter arm 122 under spring load by a larger pinch roller section shown at 106A in FIGS. 3 and 4.

The detector assembly 110 can be moved toward the side plate 21B on the right-hand side of the frame in order to sense the longitudinal edge of the sheet and the longitudinal mark by the right edge of the sheet 13 by moving the cutter assembly 120, through operation of the stepper motor 164, laterally toward side plate 21B, against the spring pressure of spring 172. The cutter assembly arm 122 and the detector assembly arm 112 are mounted on the same shaft 114 so that the ends of the respective arm hubs will engage and the detector assembly 110 is then moved toward the adjacent side plate 21B. This is done under a program for sensing the longitudinally extending index marks 19B and 19D.

The sheet 13 is driven by the feed roller 88 and indexing roller 104 as stated. The pinch roller 106 is lifted slightly when loading the sheet so the sheet 13 can shift slightly. The front or leading edge (top of form) of the sheet 13 is sensed by light sensor 119, and the sheet length to the trailing or rear of the sheet is calculated. The controls for the motor 80, which drives indexing roller 104 are provided the information of sheet length and the signal from sensor 119, so the index roller 104 will feed the desired sheet length without further sensor input.

When the sheet rear edge has been advanced sufficiently, the stepper motor 80 and clutch operate to shift the scoop plate 66 and the guide hood 92 to their positions shown in solid lines in FIG. 3. The drive motor 80 for the indexing roller 104 is reversed after the diverter has shifted. The motor 80 will be rotating in the proper direction to operate the scoop plate when engaging the clutch 79 for driving the shaft 82. This feeds the sheet 13 in reverse across the top of the feed roller 88 (which is also driven in reverse by the gear train) and the sheet 13 will move on a plane approximately tangent to those two rollers 104 and 88 into a tray (not shown) comprising a conventional rack or other support forming an eject tray.

The movement of the paper diverter scoop plate to its position in FIG. 3 permits the printer to print another sheet. The sheet 13 which has the printed labels on it is reversed so that the leading edge is moved back toward the LED's 118A and 118B and optical sensor 119 until the leading edge of the sheet is again sensed by sensor 119 by a changing output voltage from sensor 119.

The light sources or LED's 118A and 118B are used one at a time, and not together, when they are different colors. One red and one blue light source have been found to detect most of the combinations of paper background color and printing colors that are used. While red printing on a white background is essentially invisible using a red light, the blue light can distinguish this contrast easily. However, a blue mark on a white sheet is difficult to detect using blue light, but red light provides contrast. Blue light will disclose a yellow mark adequately. Thus the selection of red and blue lights as the sources is preferred, although yellow, orange or other light colors can be used in combination with red or blue.

The optical sensor 119 is in chamber 113 of housing 111 oriented to receive reflected light through aperture 113A, which is sized so that it is small enough to expose to optical sensor 119 only a small area on the paper surface, so the sensor will not "see" both edges of the registration mark lines at the same time. In other words the aperture has to be narrower than the width of the registration mark for maximum contrast, so that the edges of the registration mark can be detected more accurately by a rising or falling sensor output.

However, the aperture 113A also has to be large enough to provide a certain amount of light reflected from white paper so the sensor 119 is able to sense that the sheet is present below aperture 115 of plate 109 of the light sources.

Another important feature is the control system for the light sources and the optical sensor. Part of the controls are on circuit board 116, but also in FIG. 5 a block diagram illustrates relationship to a master cutter controller 190 shown in FIG. 7 and other controls for the optical detector. As shown in FIG. 5, the light sources 118A and 118B are controlling by the master controller 190 through an optical sensor and light controller that is indicated at 180. This controller is part of the detector controller shown as block 199 of FIG. 7. The light sources 118A and 118B are connected through digital to analog converters 181A and 181B so that the voltage provided to the light sources (118A and 118B) can be adjusted by a voltage controller 182 by changing the digital input to the converters 181A and 181B. The optical sensor 119 is connected to an analog to digital converter 184 to digitize the voltage output signal from the sensor and provide it to the voltage converter or voltage adjust circuit 182 that will then adjust the voltage to the appropriate light source that is illuminated, namely 118A or 118B, until such time that the output voltage from the sensor 119 reaches 2.5 volts maximum on blank paper. The sensor 119 is selected so that for more reflected light intensity the output voltage goes lower. The adjustment is when the sheet 13 is in position to reflect light.

If the sensor output is above that level, the current to the light source is increased, and if the voltage output from the sensor is lower than 2.5 volts, the current to the light source may be decreased. The light source automatically adjusts under software control. Once the detector is turned on with a light source illuminated, and the leading edge of the sheet (top of form) is sensed, the detector assembly 110 is moved on shaft 114 by operating the motor to drive the cutter and detector assembly all the way to the right so that the light source goes off the right edge of the sheet. The detector assembly 110 is in its most left position initially as urged by the spring 172. Then the cutter is moved to the left, followed under spring load by detector assembly 110, until the edge of the sheet 13 is located. The detector assembly 110 is moved under programmed control a selected distance more left or inwardly more, for example approximately 1/10 of an inch.

The controls select the first LED or light source 118A, for example initially, and the sheet is advanced to a distance that would normally result in sensing the lateral or horizontal bar or target 19A. If the mark or target is sensed, there is a change in voltage at each edge of the registration bar or line. The centerline of the bar 19A is calculated and stored in the controller as the "y" position. Then the controller 190 moves the detector 110 to the right (along the x dimension) less than 0.1 inches, and if the longitudinally extending registration line is sensed, the position of the edges of the bar 19B are detected and the centerline of the bar is calculated. The location of the printing in x dimension is thus obtained.

Then, in order to determine angular error or skew, the sheet 13 is advanced through the cutter feed rolls under control until a second vertical line registration mark shown schematically in FIG. 2 at 19C would normally be aligned with the aperture along the x axis. The detector assembly for sensing the registration mark or target is moved to its most right position and then moved left until the edge of the sheet 13 is located as indicated by the signal from optical sensor 119. The sheet 13 is then driven to determine whether the mark 19C is sensed, and if that mark is present, the detector target assembly is moved to the right to a position to sense the vertical line or bar mark 19D.

If there is a third registration mark on the sheet 13, farther up along the longitudinal edge, which is not illustrated, the same sensing would be made for the mark horizontal line and the vertical line. Then the amount of skew can be calculated by determining the offsets of the vertical lines 19A and 19D, or any other vertical lines on a registration mark that are provided.

Referring back to the initial sequence of sensing, if the first LED 118A is initially selected and no horizontal registration line mark is sensed in the first steps, the detector assembly is moved to the left a small amount for a second try, and then, if the second LED 118B has not yet been operated, it is selected and the first LED 118A is shut off so that a different color light is then being used. The steps of determining whether or not the target line or bar 19A is present are repeated. If there is then a sensing of the mark the second LED 118B is used for the rest of the sequence.

If neither LED works, then there is an end of sequence signal and the sheet is rejected. Finding the horizontal line 19A is determining the registration mark vertical offset, and finding the vertical line of 19B is called determining the horizontal offset. The LED current is set at each instance to be that which was originally adjusted so that the sensor voltage output when light is reflected off the sheet 13 surface is less than 2.5 volts.

The offsets from the vertical or longitudinal edge of the paper of the two spaced vertical lines or bars 19B and 19D is used to calculate the skew. The horizontal and vertical offsets will be provided to the controller 190 to locate the printed material on the sheet 13. It is not necessary that the sheet is square with the printed material, but the cutter has to cut out around the printed matter accurately, so that the signals from the optical sensor 119 are used for orienting the cutter program to controller 190 and providing corrections to the program as needed.

It can be seen that using the red and the blue LEDs alternately and automatically, the paper and ink color do not have to be known by the sensor control program, and the digital to analog adjustable light levels for the light sources and the analog to digital converter used for the reflected light level sensing makes it possible to automatically calibrate, adjust and sense for a mark in one pass in most cases. The accuracy of the mark location is increased by the analog to digital sensing rather than just using a fixed logic on/off threshold input from the sensor. The input voltage can be digitally resolved to voltage steps that are 0.02 volts (5 V/256 steps) for insuring adequate light for detecting rather than a simple on versus off state detected with a fixed threshold, which may vary from printer to printer.

Also, in the inverted case, where the paper is dark and the print is light, the sensing scheme is reversed and can be accommodated with the present arrangement.

The edge crossing information sent to the controls and the calculated centerline of the registration mark bars or lines gives the controls for the cutting operation a reference location. It is known where the cuts should be made once the reference position in x and y directions have been determined because the registration marks are indexed precisely to the printing that was carried out. Correction for any skew that may be present also is calculated. The cutting or other operation are then carried out using suitable controls.

The particular sequence of sensing the registration marks is merely illustrative, and is one way of carrying out the function. Other sequences can be utilized as well using the detector arrangement of being able to select one of two different light sources for the detector.

Figure 7:
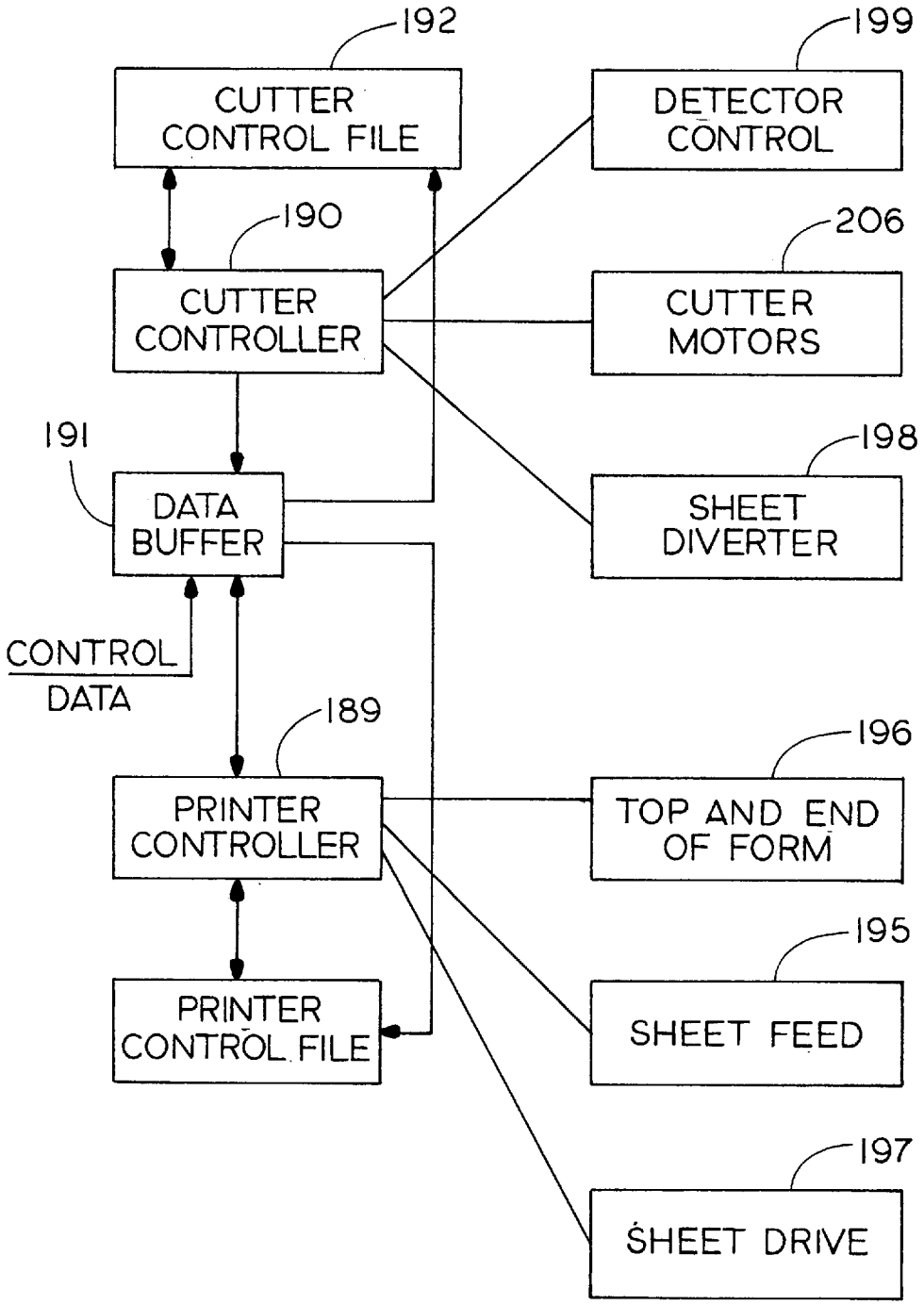
FIG. 7 is a simplified block diagram of controls used with the detector of the present invention.

FIG. 7 is a schematic block diagram representation of controls for the printer-cutter assembly. A pair of controllers are used for operating the system. A printer controller 189 and a cutter controller 190 are both connected to receive input data from a buffer 191. The buffer 191 receives the control data at an input. The cutter controller 190 also passes data to the cutter control file 192 or printer control file 193, as appropriate. Once the printer control file has been received, the printer controller 189 starts a sheet feed represented by block 195 to feed a sheet from a paper supply toward the printer, and to operate the provided sheet drive or feed rollers represented by block 197. The provided sensor senses the top of form at block 196 using the sensor 62 described, and that signal is stored in memory. The signal for the end of the sheet or form is sensed so the sheet length is calculated by the printer controller and also stored in memory for both the printer and cutter controllers.

The printing then continues under control of the printer controller 189 which controls the sheet drive and printer head in accordance with the program provided. When the print operation on a sheet is completed, a signal is received by the cutter controller 190. The cutter controller sets the sheet diverter comprising the scoop plate 66 and the sheet guide hood 92, as represented by the block 198. The cutter controller 190 controls the cutter sheet feed and index rollers as explained. The front edge of the sheet is sensed by the optical sensor and used to determine when the sheet is in the cutter indexing roller.

Once the trailing (rear) edge of the sheet is advanced to be on the cutter feed roller, a signal is sent to the cutter controller 190 and the cutter indexing roller operates to reverse the direction of sheet movement until the front edge of the sheet is again sensed. This signal is used to indicate that the detector is to sense the horizontal detector mark line or bar on the sheet and the vertical bar or line in the sequence explained. When detected the position information is used for referencing the cutter control program for the cut vectors.

The cutter motors represented by block 206 are operated to move the cutter assembly 120 under control of the registration mark sensor controller 199 for controlling the detector assembly 110 in the initial steps for finding the registration mark. The control program for the registration mark sensor control 199 is a software program inputted to the cutter controller and carried out under the cutter controller direction. The steps outlined for sensing are programmed as desired. These motors are also controlled for carrying out the cutting steps under the control of the cutter controller 190. After the step 198, when the sheet diverter is set to its initial position, the printer can operate through its steps of feeding another sheet, sensing the sheet length, printing the labels and providing the print complete signal.

When the cutter operation on the first sheet is completed, the cutter section receives the second printed sheet from the printer through the sheet transfer section and the detection of the registration marks for detecting offset and skew is repeated before the next cutting operation.

An alternative method to the preferred embodiment would be to use a sensor array instead of single sensor 119, and a glass lens to focus the image of registration mark 19 onto the sensor array. This method would provide better resolution and additional image contrast.

Although the present invention has been described with reference to preferred embodiments, workers skilled in the art will recognize that changes may be made in form and detail without departing from the spirit and scope of the invention.

What is claimed is:

1. An apparatus for registering a sheet position and performing an operation on a sheet referenced to a registration mark on the sheet, comprising:

a positioning mechanism for causing relative movement between the sheet and a tool performing the operation, based upon control signals;

an optical detector mounted on the apparatus providing a sensor output in response to detection of a registration mark on the sheet, the optical detector including first and second light sources directed toward the sheet, each of the light sources providing light of a different color from the other, and a light sensor to sense light reflected from the sheet; and control circuitry connected to the light sources including a control to first select a first of the light sources for illuminating a registration mark on a sheet and subsequently selecting the second light source for illuminating the registration mark in response to absence of a signal from the light sensor when using the first light source.

2. The apparatus of claim 1 including a housing mounting the light sources and the light sensor as a unit.

3. The apparatus of claim 2, wherein said light sources have focal axes, said focal axes being positioned at angles relative to each other such that the axes intersect substantially at a point on an associated sheet.

4. The apparatus of claim 3, wherein the light sensor is positioned between the light sources and has an axis aligned with the point and substantially perpendicular to an associated sheet.

5. The apparatus of claim 1, wherein the light sources comprise a red light source and a blue light source.

6. The apparatus of claim 1, wherein said control circuitry further includes a current adjustment circuit for adjusting current to the light sources, the light sources being connected to the control circuit through digital to analog converters, and the light sensor providing an output voltage signal indicative of reflected light from a sheet, said output signal being connected to said control circuitry through an analog to digital converter, the current adjustment circuit adjusting the current to the light sources selectively to provide an output voltage from the light sensor that is at a desired level.

7. An optical detector assembly for detecting contrasting registration marks on a sheet through optical sensing of reflecting light comprising a support for operably holding the optical detector in position adjacent a sheet, and causing relative movement between the sheet and the sensor;

the optical detector including a pair of light sources of different colors directed toward the sheet, and a light sensor to sense light reflected from the sheet; and a control circuit for initially energizing a first of the light sources and moving it across a known position to sense the registration mark on the sheet, and for selecting a second light source when the signal from the light sensor indicates lack of a registration mark at the known location using the first light source.

8. The optical sensor of claim 7, wherein the support comprises a common housing having a chamber mounting said light sources and said light sensor, the housing having an aperture from the chamber facing the sheet through which reflected light is directed to the light sensor, the aperture being of a selected size in relation to a registration mark on a sheet, such that the light sensor senses edges of such registration mark.

9. The optical sensor of claim 7, wherein the support comprises a common housing mounted for movement relative to a sheet, said light sources and said light sensor thereby being movable relative to the sheet as a unit.

10. The optical sensor of claim 9, wherein said light sources are angled relative to a central axis of the light sensor, the light sources having central axes of light that intersect with the axis of the light sensor substantially at a selected distance from the light sensor.

11. The optical sensor of claim 7 including a control to provide digital incremental changes in current to the light sources, said control receiving a signal from the light sensor and adjusting the current to at least one selected light source until the output from the sensor equals a predetermined voltage when the one light source is reflecting light from a sheet which is sensed by the light sensor.

12. A method of detecting registration marks on a sheet using a sensor that is movable along at least one axis relative to the sheet, comprising the steps of:

providing a registration mark on the sheet having a contrasting reflectivity relative to the surface of the sheet;

providing a pair of light sources of different colors to direct light onto the sheet and a light sensor to sense reflected light from the sheet;

energizing one of the light sources and relatively moving the one light source and light sensor across the registration mark and determining whether the presence of a registration mark is sensed by the light sensor; and in response to a determination that the registration mark is not sensed selecting the second light source and relatively moving the second light source and light sensor across the registration mark to sense the position of the registration mark.

13. The method of claim 12, including the step of detecting a second portion of the registration mark by passing the light source across the second portion of the registration mark in a second axis upon receipt of a signal from the light sensor indicating the sensing of the first mentioned registration mark.

14. The method of claim 13 including the step of determining the location of an edge of the sheet adjacent the second registration mark, the second registration mark being directed generally along an axis coextensive with the edge of the sheet, sensing a third registration mark spaced in direction along the edge of the sheet from the second portion of the registration mark, and determining the offset of the third registration mark relative to the edge of the sheet from the second portion of the registration mark.

15. The method of claim 12 including the step of printing material on the sheet oriented at a known relation relative to the registration marks prior to the first determining step, and performing an operation on the sheet at locations related to the printed material adjusted for position by the sensed positions of the registration marks.

* * * * *